US008212669B2

(12) United States Patent
Brunetti et al.

(10) Patent No.: US 8,212,669 B2
(45) **Date of Patent: *Jul. 3, 2012**

(54) REMOTE AREA MONITORING SYSTEM

(75) Inventors: Sam F. Brunetti, Falls Church, VA (US); Peter C. Davis, East Aurora, NY (US); Katrin G. Helbing, Fairfax, VA (US); Chethen B. Reddy, Herndon, VA (US); Gary D. Roberts, Huntington, MD (US); David M. Stinnet, Ashburn, VA (US)

(73) Assignee: BAS Strategic Solutions, Inc., Gainsville, VA (US)

( * ) Notice: Subject to any disclaimer, the term of this patent is extended or adjusted under 35 U.S.C. 154(b) by 1003 days.

This patent is subject to a terminal disclaimer.

(21) Appl. No.: 12/131,615

(22) Filed: Jun. 2, 2008

(65) Prior Publication Data

US 2009/0237247 A1 Sep. 24, 2009

Related U.S. Application Data

(60) Provisional application No. 60/942,872, filed on Jun. 8, 2007.

(51) Int. Cl.
*G08B 13/00* (2006.01)

(52) U.S. Cl. ..... 340/541; 340/540; 340/573.4; 348/153

(58) Field of Classification Search ..... 340/541, 340/905, 917, 925, 573.4, 506, 522, 565, 340/568.1, 573.1, 545.7, 545.1, 609, 5.1, 340/540; 348/149, 153, 154; 705/1, 10, 705/159, 163

See application file for complete search history.

(56) References Cited

U.S. PATENT DOCUMENTS

| | | | |
|---|---|---|---|
| 5,819,124 | A | 10/1998 | Somner et al. |
| 5,991,429 | A | 11/1999 | Coffin et al. |
| 6,091,771 | A | 7/2000 | Seeley et al. |
| 6,154,133 | A | 11/2000 | Ross et al. |
| 6,396,533 | B1 | 5/2002 | Hudson |

(Continued)

FOREIGN PATENT DOCUMENTS

| | | |
|---|---|---|
| EP | 0772169 | 5/1997 |
| GB | 1403560 | 8/1975 |
| WO | WO99/59116 | 11/1999 |

*Primary Examiner* — Anh V La

(74) *Attorney, Agent, or Firm* — Polster, Lieder, Woodruff & Lucchesi, L.C.

(57) ABSTRACT

A Remote Area Monitoring System (RAMS) for detecting movement in a disallowed direction through a passageway (P). The RAMS monitors two volumetric spaces that are established by the system, both of which spaces are defined with respect to depth, width, and height. Both a warning zone and an alarm zone are defined for each space. The warning zone protects against inadvertent incursion into the protected spaces; while the alarm zone protects against intentional intrusions thereinto by movement in the disallowed direction. The RAMS automatically monitors both zones and does not require human vigilance to detect and warn of an incursion or intrusion. Human traffic, in both directions through the zones, is monitored; as well as the movement of objects. Movement of humans is detected using a sensor (16) employing machine vision technology including multiple overhead modules (12) linked together so to cover the passageway through which pedestrians travel. The zones covered by the modules overlap so to insure that there are no gaps in coverage. A sensor (18) employs near infrared (IR) imaging techniques to detect thrown or tossed objects. A workstation (20) includes a display (52) where alarm events are recorded and logged. The workstation also includes recording (34) and printing (36) equipment to aid in apprehension of an intruder.

34 Claims, 6 Drawing Sheets

U.S. PATENT DOCUMENTS 6,597,391 B2 * 7/2003 Hudson ..... 348/153
7,535,353 B2 * 5/2009 Hirai et al. ..... 340/541
7,671,728 B2 * 3/2010 Buehler ..... 340/506
2008/0100438 A1 5/2008 Marrion et al.
2008/0118106 A1 5/2008 Kilambi et al.

* cited by examiner

REMOTE AREA MONITORING SYSTEM

CROSS-REFERENCE TO RELATED APPLICATIONS

This application claims the benefit of U.S. provisional patent application 60/942,872 filed Jun. 8, 2007, and is incorporated herein by reference.

STATEMENT REGARDING FEDERALLY SPONSORED RESEARCH

Not Applicable.

BACKGROUND OF THE INVENTION

This invention relates to a method and apparatus for remotely monitoring an area of interest; for example, a pedestrian passageway such the entrance into, and exit from, a concourse in an airport terminal; and more particularly, to detecting a security breach resulting from inadvertent or intentional wrong way travel of people and objects through an exit passageway and to provide an immediate and specific indication thereof.

For some time now, airport concourses have been secured areas to which only authorized individuals (employees or screened passengers) are permitted access. Nonetheless, these are areas of high traffic volume with large groups of people going in one direction to reach a gate, and in the opposite direction to retrieve their luggage, access parking or ground transportation, etc. While perhaps the readiest example of a high volume, secure area, there are other areas such as those in government offices, military facilities, etc. where relatively large numbers of people are constantly moving into and out of secure areas.

It is commonplace with these secure areas that while access into the area requires movement through some type of screening, the exit passageways are relatively open. That is, there are usually no fixed barriers such as doors or gates through which a person has to pass so that people can move rapidly and unencumbered through the exit. However, there is usually at least one guard posted in this egress passage to prevent people from entering into the secure area through it, thereby bypassing the security screening. While guards are usually effective, there are, nevertheless, numerous instances of security breaches in which someone has gotten past the guard and escaped into the secure area. When this occurs in an airport, the concourse is typically evacuated, and all passengers waiting for planes have to be re-screened. As a result, numerous flights are delayed, all at an enormous cost in time and money to the airport, the airlines, and the passengers.

Studies have shown that security guards or monitors, regardless of how dedicated, do not provide the vigilance that is required for prolonged periods of time. After a while, they become tired and can be distracted. Or, it is not uncommon for a guard to be diverted from his or her task in order to render assistance to someone in need. In either instance, the way is made clear for a wrong-way traveler to enter into the secure area through the exit passage, and to do so undetected.

It is known for airport security systems to include video monitors installed in an exit passage to view movement of people through the passage. It is also known to sense wrong-way movement of people in this area, and to "sound" an alarm when wrong-way movement is detected. Typically, when an alarm occurs, frames of imagery showing the passage and the people in it at the time of the alarm are captured and analyzed. A drawback with conventional analysis is that it looks for movement only in one direction through the passage. This is so, even though these systems may be capable of perceiving movement in both directions.

BRIEF SUMMARY OF THE INVENTION

The present disclosure is directed to a Remote Area Monitoring System (RAMS™) which is installed in security environments where detection of people or objects moving in a disallowed direction is critical and a rapid response to a detected movement necessary. The RAMS employs both a method and apparatus for passively and unobtrusively detecting movement within an area of interest such as a passageway without impeding traffic flow through the passageway. Detection apparatus of the system monitors two volumetric spaces that are established by the system. Both of these spaces are zonally defined with respect to depth, width, and height. One defined space comprises a warning zone and the other defined space an alarm zone. The warning zone is monitored against inadvertent incursion into a protected space; while the alarm zone is monitored against intentional intrusions thereinto. Besides detecting and warning of incursions or intrusions, the system further detects undue loitering in either zone and provides an alert or warning to a system monitor.

The apparatus automatically monitors both zones, simultaneously, and does not require human vigilance to detect and warn of an incursion, intrusion, or loitering. The apparatus monitors human traffic, in both directions through the zones; as well as the movement of objects propelled through the zones whether the objects are thrown or tossed through the air, or slid or rolled along a floor. For the detection of humans, the apparatus employs reliable machine vision technology including multiple overhead modules linked together so to completely cover the passageway through which pedestrians travel and to monitor the movement of people from frame to frame of the processed video. Areas covered by the modules overlap so to insure that there are no gaps in coverage. Near infrared (IR) imaging techniques are used, in one embodiment, to detect thrown or tossed objects. Detected people and objects are viewed using high resolution cameras. The apparatus also includes a user-friendly workstation having a lockable rack for installation of the peripheral hardware used with the detectors.

As a method, the invention includes automatic archiving of alarm event data and imagery. This information is date and time stamped, and the location is also recorded. Alarm event information is automatically replayed, and warning event information is replayed when requested. Archived information is retrievable from the workstation. This data can be transmitted to other sites for permanent archiving and analysis, and printouts of pertinent information is done onsite.

The RAMS is readily customized so that the same platform can be used in a wide variety of installations. Once in operation, the system reduces the workload otherwise imposed on security or monitoring personnel while insuring that area security is constantly maintained.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

Description of the Preferred Embodiment

Figure 1:
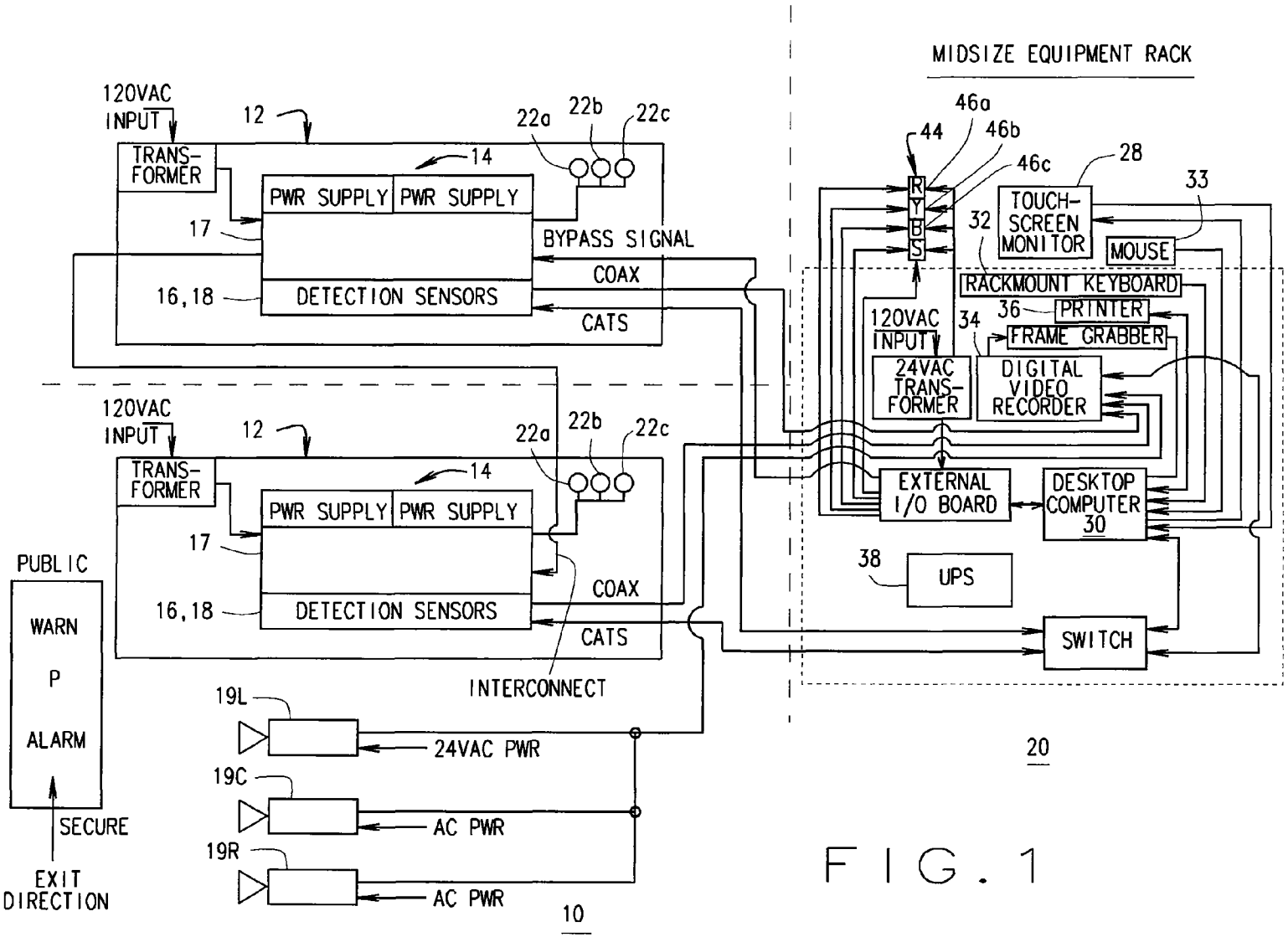
FIG. 1 is a block diagram of the remote area monitoring system of the present invention and illustrating the interconnection of the components of the system.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a remote area monitoring system (hereinafter "RAMS") is indicated generally 10 in FIG. 1. The RAMS includes an overhead module 12 in which is mounted a sensor suite 14 that monitors a volumetric area defined in depth, width, and height. As shown in FIG. 1, this area includes both a warning zone and an alarm zone. RAMS 10 automatically monitors the activities in a pedestrian passageway P for wrong-way travel into a secured area; this being done without impeding exit traffic flow. Using advanced machine vision sensing technologies as described hereinafter, RAMS 10 generates an alarm if a security breach is detected. In one embodiment of the invention, a sensor 16 of sensor suite 14 monitors the direction of travel of larger, slower moving objects such as people; while a second sensor 18 tracks small, fast moving objects that are tossed, slid or rolled through the passage. In a second embodiment of the invention, the sensor 16 performs both monitoring functions; while in a third embodiment a plurality of cameras 19 shown in FIG. 1 are used for object detection. A processor 17 incorporated in a printed circuit board in module 12 processes the video signal inputs from the various sensors. Alternatively, each camera or sensor can include a "mini" processor for processing the video signals. Regardless, the processor, or processors, includes video analysis software including algorithms for distinguishing between individuals, individuals and objects, and the directions of movement of both.

Figure 5:
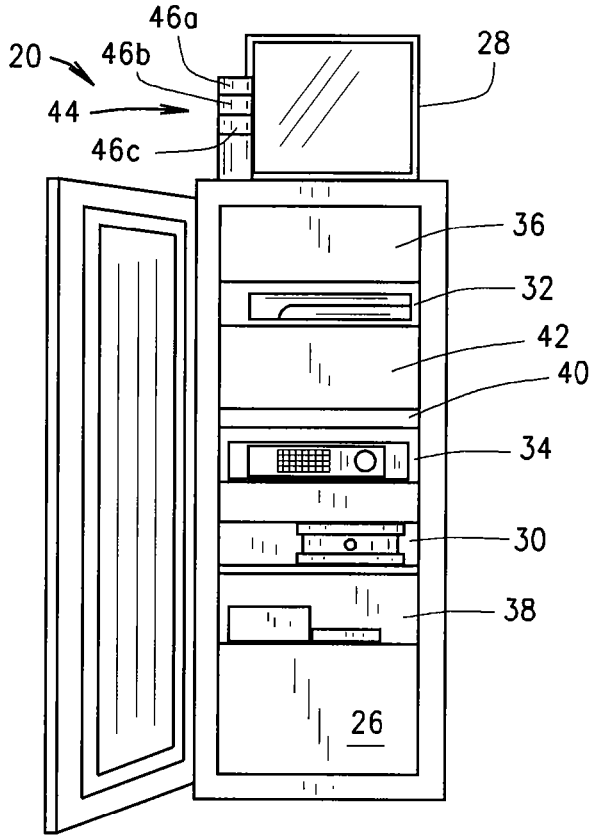
FIG. 5 is an elevation view of an operator workstation used in the system.

Next, RAMS 10 includes an operator workstation 20 which, as shown in FIG. 5 is a self-contained, mobile unit. The workstation includes a rack 26. Mounted in, or on, the rack are a number of components. Interconnection between these components, and between the modules 12 and the workstation is diagrammatically shown in FIG. 1.

Installed on top of rack 26 is a monitor 28 which is, for example, a 17" color flat panel monitor mounted on a stand which allows it to be swiveled by an operator for easy viewing.

Next, the workstation includes a desktop or personal computer (PC) 30 with associated keyboard 32 and mouse 33. PC 30 is, for example, a Pentium D 820/2.80 GHz 2×1M PC which manages the operator's interface with the system. This includes diagnostic functions, maintenance procedures, and supervisory access to system settings.

The mouse is a silicone-based, optical mouse used because it is durable in an environment where it is continuously exposed to the public. The mouse is impervious to liquids (water, coffee) and cleaning fluids that may come into contact with it, is washable and can be disinfected with standard aerosol cleaners.

The workstation further includes a digital video recorder (DVR) 34 which is, for example, a 16 channel DVR that records all event imagery. Using the DVR, video data can be retrieved for replay, or to print frames of imagery (screen shots) for use in intruder apprehension. DVR 34 is programmed to record, for subsequent display, the five seconds of video occurring before an alarm event, and five seconds of the video occurring thereafter. A printer 36 included in the workstation is a photo-quality printer that allows an operator to print screen shots for use in intruder apprehension.

A power backup (UPS) 38 is also mounted in rack 26. This unit is, for example, an ES 725 VA with phone and coax protection. The UPS provides surge protection and battery backup. Four power outlets are provided for battery backup and four power outlets are provided for surge protection.

Rack 26 includes a work surface 40, and/or a utility drawer 42. The rack enclosure is equipped with a closable, lockable plexiglass door 43 to protect the components installed in the rack.

Installed on top of rack 26 is a light stack or light bar 44. The light stack includes three lights, a top (red) light 46*a*, a middle (yellow) light 46*b*, and a lower (blue) light 46*c*. The function of these lights is described hereinafter.

Those skilled in the art will appreciate that RAMS 10 can be employed as a stand alone exit lane or X-control system; or more commonly, in conjunction with an ingress or Q-control system. RAMS 10 is installed in security environments where detection of people or objects moving in a disallowed direction is critical and a rapid response to a detected movement necessary, but in which it is important, if at all possible, to preclude drastic security measures such as evacuation of a building or concourse. Further, the system is a flexible and versatile system readily adapted to a variety of installations and for simultaneous monitoring of multiple exits. Those skilled in the art will understand that RAMS 10 can be installed with or without the thrown object detection (or TODD™) capability depending upon the requirements for a particular installation.

Because machines perform better at certain vigilance tasks than humans, RAMS 10 is more effective than a human guard at monitoring passageway P for wrong-way, disallowed directions of travel. RAMS 10 can detect wrong-way travel of both people and fast-moving objects that are tossed, slid, or rolled into the secured area, and records alarm and warning events for use in post-event analysis and intruder apprehension. A significant advantage of RAMS 10 is that it allows for a reduction in the number of guards or monitors stationed at egress passages. Since current airport locations usually require at least one guard at each concourse exit, RAMS 10 can produce substantial savings in personnel costs while, at the same time, performing more effective monitoring.

RAMS 10 employs both a method and apparatus for passively and unobtrusively detecting movement within an area of interest such as a passageway without impeding traffic flow through the passageway. The machine vision technologies implemented in RAMS 10 include technology used in high-speed inspection applications. Traditionally, inspection and verification tasks were completed by human observers looking at individual pieces. However, as production line speeds increased, human inspectors were unable to keep pace with inspection tasks. Machine vision was developed as a solution for use in high-speed, complex environments such as production lines. In such applications, two-dimensional video imagery is used to capture an image of the part being inspected on a single plane (i.e., a two-dimensional plane having x and y axes). The imagery is then digitized and processed, using image analysis software, to extract information from the images and generate decisions about them.

Figure 3:
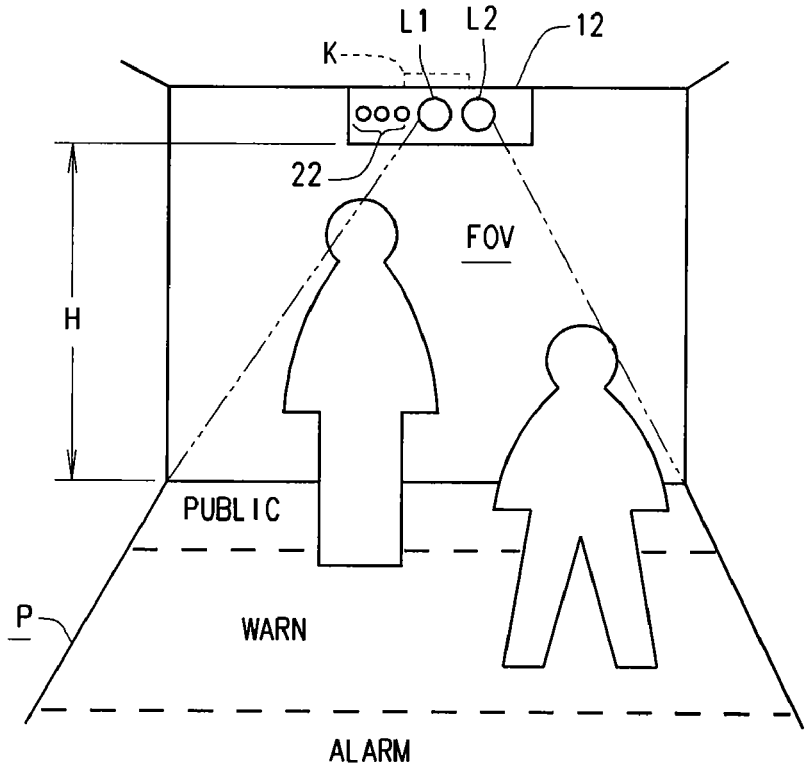
FIG. 3 illustrates an installation of a module incorporating a sensor suite for detecting people and tossed objects in a passageway.
Figure 4:
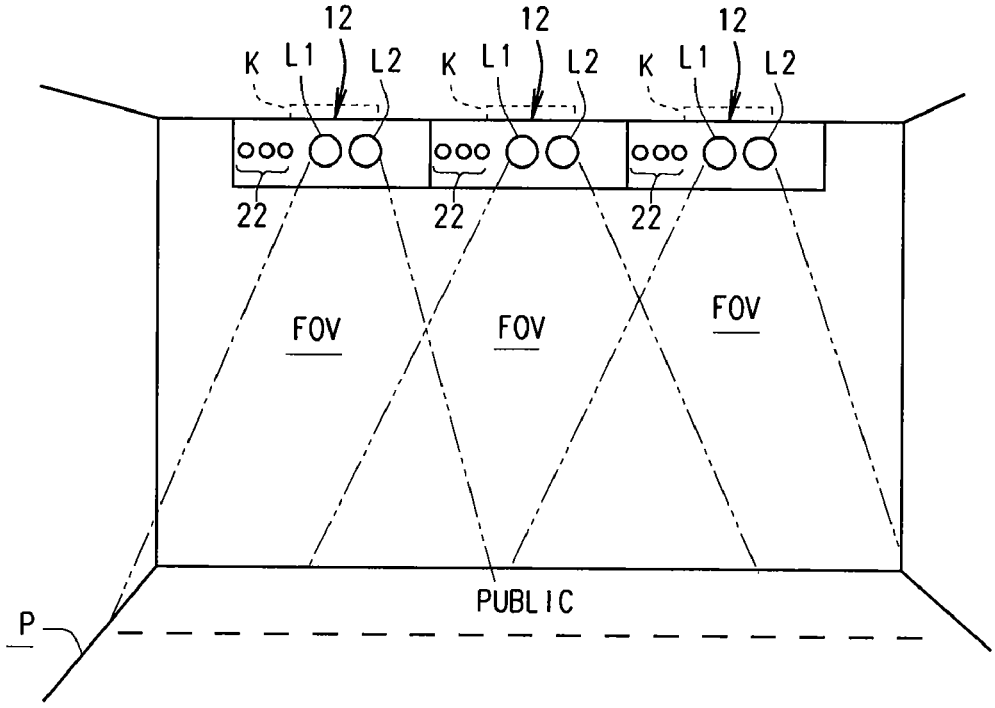
FIG. 4 illustrates an installation having multiple modules having overlapping fields-of-view so to effectively cover the entire area being monitored.

Two-dimensional monocular sensors, such as television cameras and the like, can accurately process x and y data, but they cannot distinguish between different levels (the z plane). For example, they cannot differentiate between an object on the ground and an object six feet off the ground. Unlike the monocular, two-dimensional imaging sensors conventionally employed in video detection systems, the sensor 16 used in RAMS 10 employs a stereovision sensor that examines a volume of space (x, y, and z axes). In one embodiment, the sensor employs two axially offset lenses L1, L2 in FIGS. 3 and 4 that capture different views of the object (i.e., a person entering passageway P). During installation of the system, the sensors are adjusted so to have fields-of-view (FOV) which provide complete coverage of a passageway. This is as shown in FIG. 4. The sensor captures images at a high frame rate from each lens. RAMS 10 seeks detectable, defining features of an object (the person) in a frame, such as texture and edges, so to correlate points within the space. Because the lenses of the sensor are slightly offset from each other, they capture slightly different images of the same object in the same space at the same time.

As previously noted, processor 17 (or the "mini" processors) of RAMS 10 employs complex algorithms to perform the image analysis of each frame and compare frames of imagery captured by each lens. The program correlates texture and edge information contained in each frame to map objects within the frames and determine which features belong to the same object, so to define the object based on this information. Using data calculated from the positional offset of points on the object, RAMS 10 can not only pick out and map the object in two dimensions (x and y axis data), it can also assess depth information about the object (z axis data). This capability allows RAMS 10 to ignore irrelevant features such as shadows, glare, and reflections, because these have no depth associated with them as compared to people and other three-dimensional objects. Such a capability greatly reduces the number of false alarms that otherwise occur with monocular, video-based detection systems which employ conventional video cameras or sensors. Once sensor 16 has identified a person within the space, processor 17, using the image analysis algorithms that interpret the 3-D images, compares positional data for the person within the space from one point in time (frame of imagery) to the next. People are now accurately identified, as is their location and direction of travel in the passageway, despite changes in their size and shape from one frame of imagery to another. Based upon this analysis, if the person is detected as traveling in a wrong or disallowed direction through passageway P, an alarm signal is sent by processor 17 to computer 30 for RAMS 10 to generate an alarm.

It is further a feature of RAMS 10 that, in one embodiment using sensor 16, people and other objects (non-humans) are both identified and tracked. This is important because in an airport security application, for example, it is critical to track any object, human or otherwise, moving the wrong way through exit passageway P into the secured area. As with people, RAMS 10 can identify individual objects and assess whether they are traveling in a desired direction or in a wrong or disallowed direction. If an object is detected moving in the wrong direction, an alarm is generated by RAMS 10.

In one alternate embodiment of the invention, sensor suite 14 further includes an object detection device (TODD) that employs a two-dimensional, extremely high speed near-infrared (IR) sensor 18 to capture and provide imagery of relatively small, fast moving objects that are move through the space. Sensor 18 "ignores" people and other large, slower moving objects (animals, luggage, etc.). However, as with sensor 16, if sensor 18 detects an object moving in the wrong direction through passageway P, an alarm is generated by RAMS 10.

Figure 6:
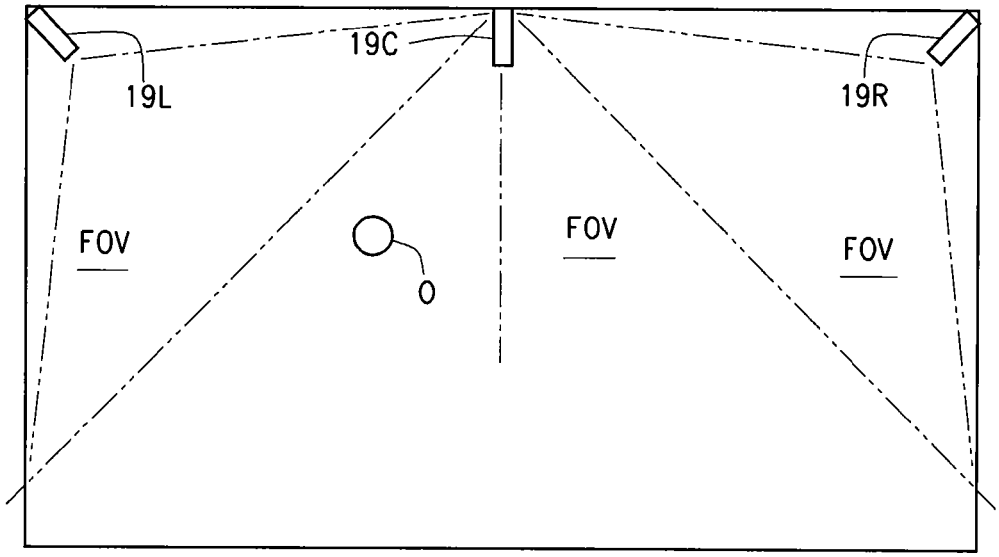
FIG. 6 is an illustration of a camera installation for detecting tossed objects.

Next, as shown in FIG. 6, in another embodiment of RAMS, the TODD includes three high speed cameras 19L, 19C, and 19R. The cameras are installed above passage P with one camera 19C mounted above the center of the passage, and the other two cameras 19L and 19R above the left and right sides, respectively, of the passage. In the configuration shown in FIG. 6, the cameras provide full coverage of the passage and there are no "blind" spots. In addition, each location within the space defined by the floor and sides of the passage are visible to at least two of the three cameras. This makes it possible to triangulate an object O within the passage and find its location, in three-dimensional space. As with the other described embodiments, this configuration prevents false alarms otherwise resulting from shadows, reflections and highlights.

Figure 2:
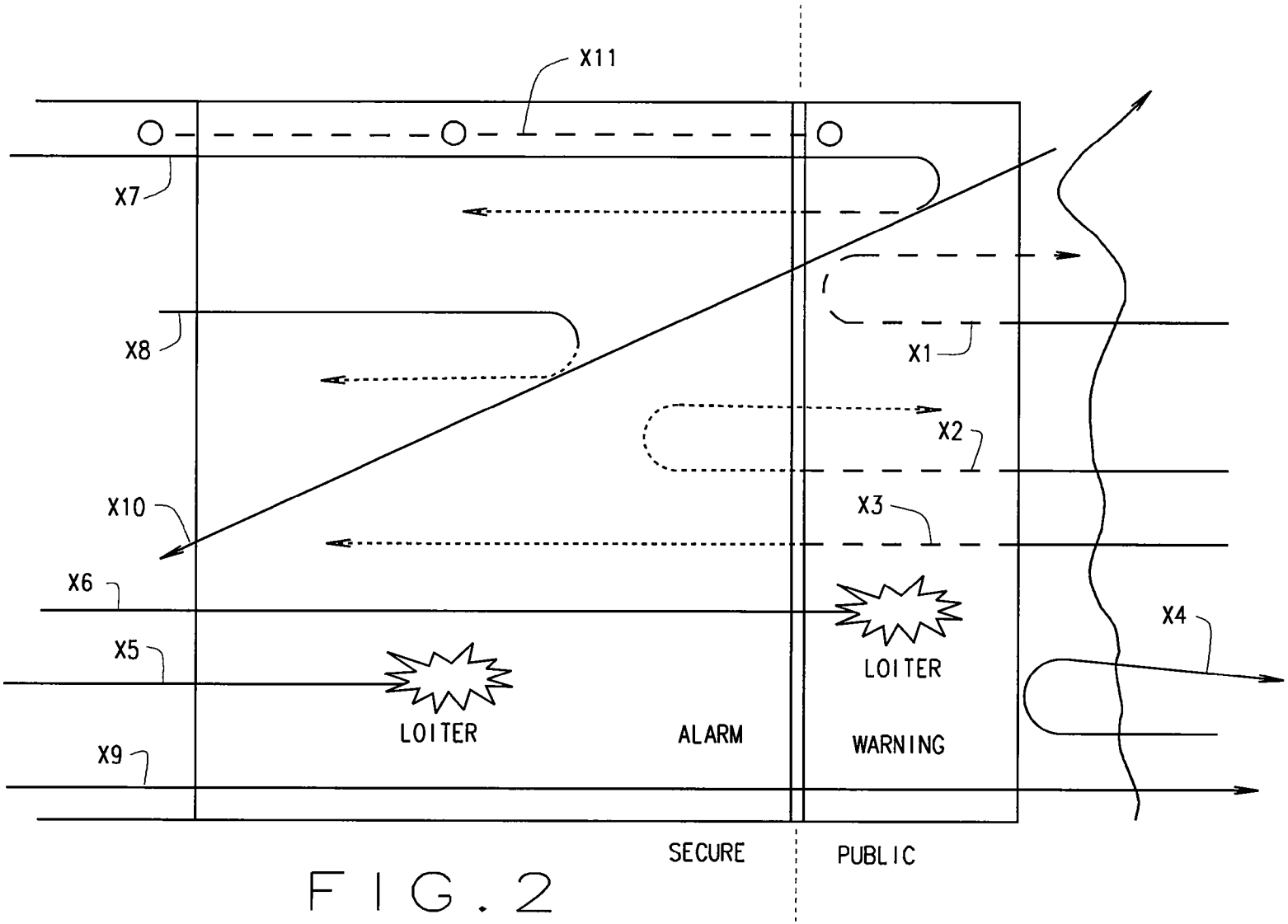
FIG. 2 is a representation of a passageway monitored by the system and indicating respective areas in which a warning or an alarm is sounded for different types of movement by people or objects through the passageway.

Referring to FIG. 2, RAMS 10 detects the movement of people and other objects moving through passageway P. In performing this function, RAMS 10 is designed to ignore certain exit activity (i.e., movement of people from the secure area into a non-secure, public area), but to generate warnings or alarms if a person or object is detected approaching or entering into the secure area from the public area using the exit lane, re-entering the secure area after exiting from it, or loitering in the area for longer than a predetermined period of time.

During system installation, RAMS 10 establishes two customized detection zones—a warning zone and an alert zone. Referring to FIG. 2, the two detection zones are established between the public area and the secure area of the facility. The warning zone is typically established within the public area and is adjacent to the alert zone. The alert zone begins at the boundary between the public zone and the secure zone, and is adjacent to the warning zone. In the one described embodiment of RAMS, within each zone, sensors 16 and 18 of sensor suite 14 monitor for wrong-way travel, by people or objects, from the public zone into the secure zone. Sensors 16 and 18 can be customized for each installation of RAMS 10 so the respective warning and alert zones can be adjusted for that particular site. In addition, specific items (i.e., the "coffee cup" effect) can be defined so that the presence of these will not cause an alarm to be generated. This customization further minimizes the number of false alarms generated by RAMS 10.

As noted, the warning zone is a system-defined area in the public space immediately before the secured area. In operation, warning indications are generated when a person or object is detected moving the wrong way within the warning zone as indicated by the dashed lines X1, X2, and X3 in FIG. 2. The warning is generated even if the person doubles back as indicated by the line X1 while still on the public side of passageway P. However, if the person progresses from the warning zone to the alarm zone, an alarm is generated even if the person turns back into the warning zone as indicated by line X2, as well as if the person continues in the wrong way down passageway P as indicated by line X3. With respect to the person traveling path X2, the alarm will not be downgraded to a warning if the person returns to the public area; for once an alarm is generated, it cannot be downgraded. No warning or alarm is generated if a person approaches the warning area but never enters it as indicated by the line X4.

With respect to people or objects moving from the secure area into the public area, if a person goes from the secure area into the public area, then stops and loiters there, no warning or alarm is given. This is indicated by line X5. If they stop and loiter in the secure area for less than a predetermined period of time, no alarm is given. This is indicated by line X6. But if they loiter in the secure area for longer than that period, an alarm is given. If the person, having moved from the secure area into the public area, turns around and starts back toward the secure area, as indicated by line X7, a warning is given while the person remains in the public area; but, if the person re-enters the secure area, an alarm is given. Or, if the person turns around while still in the secure area and starts back down the passageway, as indicated by line X8, an alarm is given. If the person simply travels from the secure area into the public area and continues on their way, as indicated by line X9, no warning or alarm is given. When either an alarm or warning is sounded, the event is logged in at workstation 20 so operators of the system have a history of activity at that site readily available. This described hereinafter.

It is important to note that RAMS 10 is sensitive to, and detects, movement not only in both directions through the passage, but also movement which is not direct or a straight-line movement. If a person moves, for example, diagonally through the passage as indicated by line X10 in FIG. 2, or weaves their way through the passage in order to avoid or pass others moving through it, their movement is still captured and analyzed for detection purposes. Similarly, if an object O is thrown, tossed, rolled, or slid through the passage as indicated by line X11 in FIG. 2, its movement is still detected, even if it strikes people or other objects, bounces of the walls, floor or ceiling of the passage, is even caught by someone in the passage and relayed by them further down the passage in the disallowed direction.

Because it is a modular system, RAMS 10 allows for rapid installation at a facility with minimal disruptions to facility operations. As shown in FIG. 3, overhead module 12 comprises a single self-contained enclosure containing sensor suite 14 and processor 17, as well as installation hardware, wiring, cabling, etc. Module 12 is installed at predetermined height H above the floor of the passageway P being monitored. While this is typically ceiling height, if the ceiling is higher than the predetermined height, the module is still installed at the predetermined height H. Depending upon the size of the area being monitored, module 12 can be used singly, or in combination with other modules 12. In this instance, the multiple modules 12 are connected together to form a single unit. As shown in FIG. 4, when multiple overhead modules 12 are used, the area coverage provided by each module overlaps with that of an adjacent module so to insure complete coverage of the passageway.

The modules 12 are designed to be mounted to ceiling structures regardless of the type of material (plaster, plasterboard, ceiling tile, etc.) comprising the ceiling. Standardized adapter plate kits K are provided to simplify the overhead module installation process. These plates are light weight so they can be installed without adding bulk and weight to the overhead module. The plates also allow for universal attachment of the overhead module regardless of the installation conditions at the facility. The adapter plates are designed to be installed in one of a number of ways, so to accommodate most mounting requirements. Once an adaptor plate has been installed, the overhead module can be quickly mounted to the plate and connections to the module are made through a single point. Wires and cables run between overhead module 12 and operator workstation 20.

Figure 7:
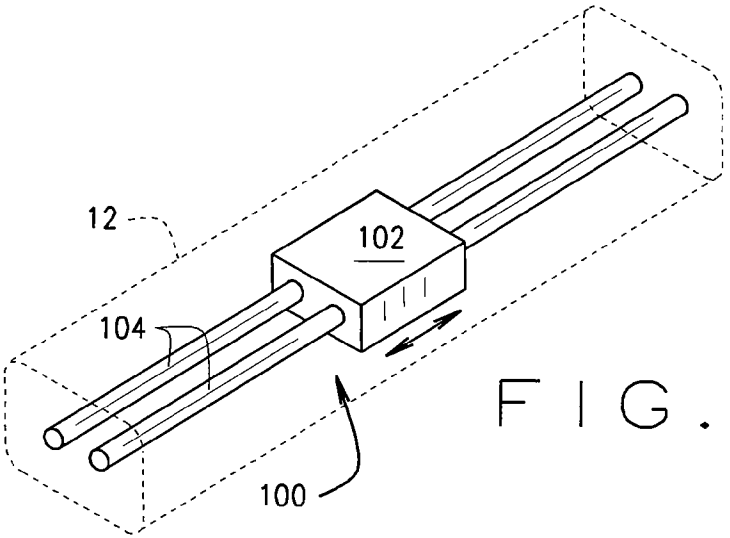
FIG. 7 illustrates a rail and carriage arrangement within a module for optimally locating a sensor suite to obtain proper coverage of a passageway.
Figure 8:
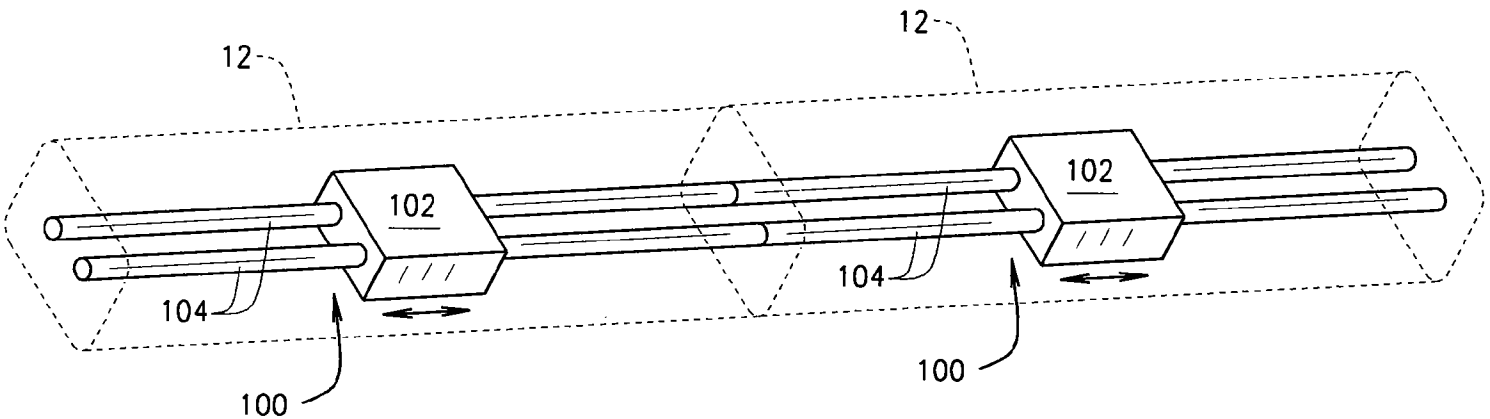
FIG. 8 illustrates a rail and carriage arrangement when two or more modules are linked together; and, FIG. 9 is a representation of a monitor for viewing an event, together with an event log and controls used by an operator to process video and other information related to the event.

As shown in FIG. 7, a rail and carriage arrangement 100 is installed within each module 12. The suite 14 of sensors 16 and/or 18 is mounted on a carriage 102 for travel along rails 104 to properly position the sensors relative to passageway P. Once a module is installed above the passageway, calibration of RAMS 10 involves moving the carriage back and forth over the rails (as indicated by the arrows) until the FOV of the sensor suite covers the entire passageway. If the installation of more than one module is required for this purpose, then the rails 104 of the modules 12 installed above the passageway are linked together, as shown in FIG. 8, to form a common rail extending the length of the modules. Now, the carriages 102 are moved back and forth over the common set of rails until the FOVs of the respective sensors sufficiently overlap so that the passageway is entirely covered. While, in general, the carriages may be expected to be positioned midway along the length of each module, given the characteristics of the particular exit passage being monitored, the carriages may well be positioned substantially to one side of a module 12 in order to provide full coverage of the passage.

Each module 12 has three light emitting diodes (LEDs) 22*a*-22*c* on its front panel 24. One diode is green when "on", one is yellow when "on", and the third is red when "on". When the green LED is "on" it means that the module has power. If it is "off", it means the module does not have power and an alert is generated at a display on workstation 20. If the yellow LED is "on", it means that each sensor has power. If it is "off", it means one of the sensors is not functioning properly and, again, an alert is generated on the workstation display. If the red LED is "on", it means that an alarm indication has been generated by the module. An alarm indicator is illuminated on the workstation display, and audible tones are triggered. The red LED remains "on" until a manual RESET button on the workstation display is pressed. If the red LED is "off", it means no alarm event has occurred.

Figure 9:
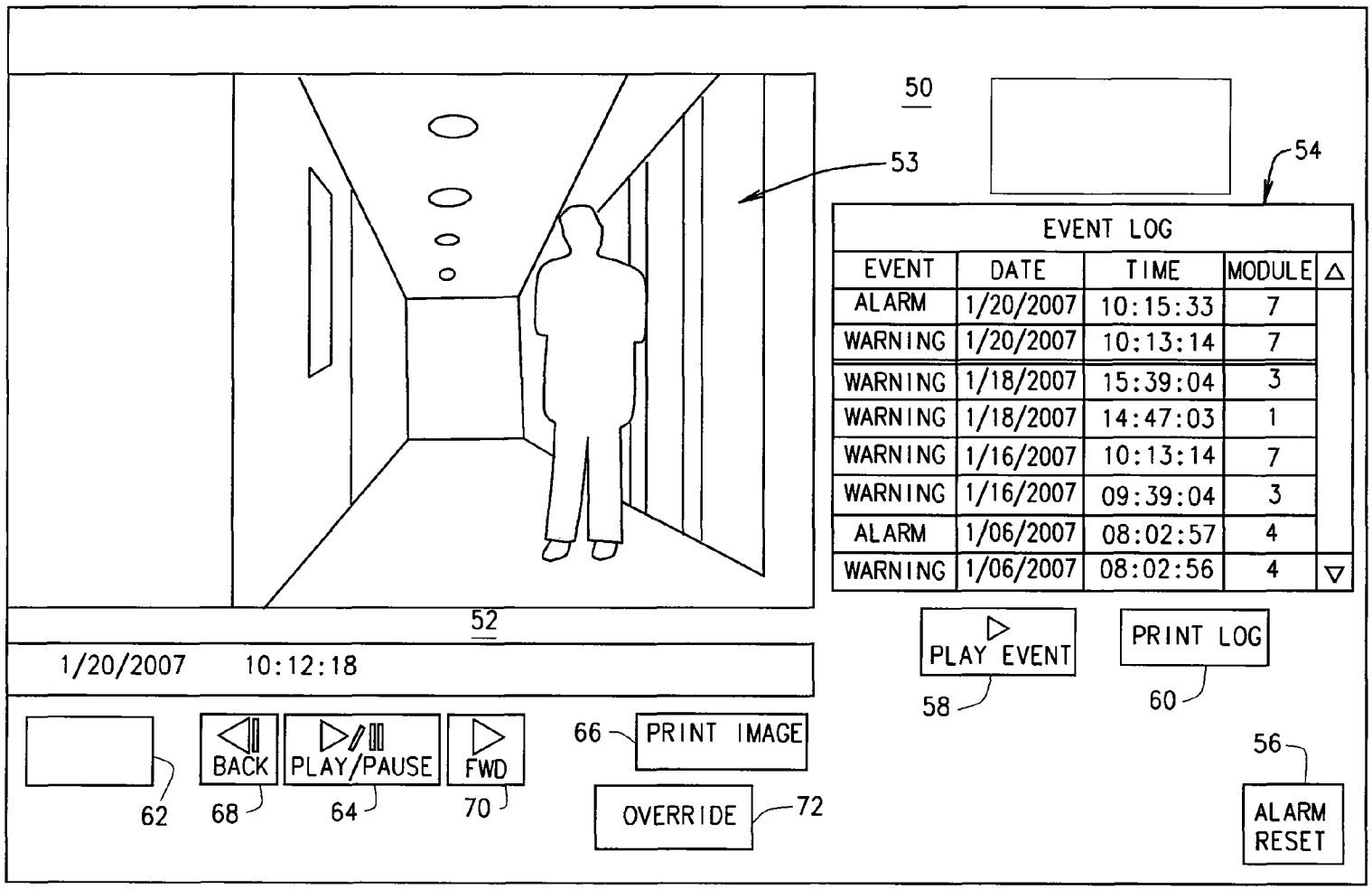

In the operation of RAMS 10, an alarm represents the highest level of a potential security threat and requires immediate attention. Alarms are presented in a number of ways. An alarm condition occurs, for example, when an intruder I such as shown in FIG. 9, is detected by RAMS 10. First, full color, high resolution event imagery showing intruder I is shown on a screen 52 of a display 50 at the workstation. If the event is an "alarm" event, the bezel 53 surrounding screen 52 turns red. At the same time, the red LED on overhead module 12 turns "on". An audio alarm is also generated. The event is automatically recorded by the DVR for automatic replay if the event is an "alarm" event; and, as previously discussed, the imagery of the intruder is automatically replayed. Occurrence of the event is also recorded and displayed in a log 54 adjacent screen 52. The alarm continues to be sounded and displayed until a supervisor resets the system. Also, red indicator light 46*a* on light stack 44 atop rack 26 is illuminated.

The event display log shown in FIG. 9 includes a number of entries. The log first includes "Event" entries which are provided in chronological order beginning with the most recent event. Entries are color coded so that, for example, the word "Alarm" under the event entry is displayed in red, while a "Warning" entry is displayed in amber. This makes it easy for an operator to readily distinguish between the types of events. Next, the log displays the date and time the event occurred. Lastly, the module housing the sensor which captured the event is listed. If the workstation is used for monitoring more than one egress passageway, listing the module identifies the location where the event occurred.

An "alarm reset" button 56 is located at the lower right hand side of the display. Pressing of the "reset" button by a system supervisor will "clear" the alarm. To thereafter subsequently view event video, an operator selects the event log 54 and presses a "play event" button 58 for the DVR to replay the recorded imagery. The contents of log 54 are printed by pressing a "print log" button 60.

A warning is a lower level indication of a potential security threat and may also require immediate attention. When a warning condition occurs, yellow indicator light 46*b* on the light stack illuminates as does the red LED on overhead module 12. Bezel 52 surrounding display screen 53 turns yellow. Now, a warning audio is generated, this alarm sounding differently from that of the audio alarm generated when an alarm occurs. The warning event is also recorded to video, and the occurrence of the event is displayed in log 54. To view warning event video, the event must be selected from log 54 and "play event" button 58 pressed. As with an alarm, a warning event is cleared by a system supervisor pressing "alarm reset" button 56.

Alerts are the lowest level of event indicators. An alert signifies an event of which a guard should be aware, but that does not pose an immediate security threat. Alerts typically indicate a system malfunction, including:

A sensor not functioning properly

A sensor that is blocked

A system malfunction (e.g. power outage) has been detected

Alerts are presented in a number of ways. The blue indicator light 46*c* on stack 44 illuminates, and bezel 52 on RAMS display screen 53 turns another color. Another, different sounding audio alarm is also generated.

RAMS operators interface with the system primarily through a dedicated RAMS display. This context-sensitive interface changes to display relevant data and activate relevant display interface elements. Operators use the mouse to click on buttons and log events. There is normally no need to input text or alphanumeric data during typical operations; although keyboard 32 is available for this purpose, if needed.

When event analysis is performed, operators can review event imagery, print out screenshots, and print event log data. As shown in FIG. 9, RAMS display 50 includes a series of buttons beneath display screen 53 for controlling viewing of the event imagery. As noted full-color, high resolution event imagery is shown on display screen 53. Also as previously noted, captured event is replayed on the screen, in a continuous loop of imagery, until the system is reset. During normal operations (i.e., non-event periods), pressing a "live view" button 62 beneath display screen 53 allows live imagery of passageway P to be viewed. This imagery, while recorded, is not stored in DVR 34. However, when an event occurs, this changes, and the DVR now begins to automatically store imagery beginning with the imagery captured five seconds prior to the event. This imagery is automatically looped on display screen 53, for an operator to immediately review it.

During a replay, the operator can freeze the display using a "play/pause" button 64, and can print any selected frame of video using a "print image" button 66. Pushbuttons 68 and 70 for "back" and "fwd" respectively allows the operator to move the playback frame-by-frame so to precisely select the best frame, or frames, for best viewing the intruder or tossed object. When the loop of imagery is paused by the operator, the "print image" function is activated so then pushing button 66 will cause the frame of imagery currently shown on display screen 53 to be printed. The event imagery and log data is printed on printer 36. This event imagery is also immediately transmitted from the workstation throughout the facility where the monitoring occurs. Since is done without first having to print the imagery and then disperse it, valuable time is saved in the critical period immediately after an event has occurred.

Events are stored in event log 54 for a predetermined amount of time after the event has occurred. After this time, event data can be retrieved by accessing DVR 34 directly and downloading the desired data. As noted, screen shots and other relevant event data can be printed to aid in event analysis and intruder apprehension using printer 36.

An "override" button 72 is provided for use in situations where a known person (or object) has been authorized to pass through the detection zone the wrong way. Examples include law enforcement or emergency response personnel who must quickly gain access to the secured area. The override button allows the operator to silence the audible tones and to suppress the visual indicators temporarily. The sensors will continue to function, and the associated event data will be recorded to the DVR. However, nuisance tones and visual indicators are suppressed. This function is activated by continuously pressing and holding the "override" button for the duration of the event. RAMS 10 will remain in the override mode only as long as the button is depressed. Once the button is released, the tones and visual indicators are available for activation. If a person is still moving the wrong way, or loitering in one of the detection zones, or a tossed object is still moving through the zones, the associated tones and indicators are activated. Requiring the operator to continuously press the override button precludes accidental deactivation and accidental failure to restore the tones and indicators.

In view of the above, it will be seen that the several objects and advantages of the present disclosure have been achieved and other advantageous results have been obtained.

The invention claimed is:

1. A method of passively and unobtrusively monitoring a passageway where detection of people or objects moving in a disallowed direction through the passageway is critical and a rapid response to a detected movement necessary comprising:

stereoscopically viewing people and objects moving in any direction through the passageway using a stereoscopic sensor with an integrated processor and generating successive individual frames of three-dimensional imagery of the people and objects as they move therethrough;

processing the individual frames of imagery to distinguish people and objects from any other people or objects simultaneously moving through the passageway regardless of the directions of movement of such other people and objects; and, providing an alarm indication if the direction of movement of a person or object is in a disallowed direction whereby people or objects moving the disallowed direction are passively and unobtrusively detected and their movement reported.

2. The method of claim 1 in which the processing further includes determining the location of each person or object within the passageway, at any location therewithin, and whereby an alarm indication is provided only if a person or object is at a particular location within the passageway and is moving in the disallowed direction therethrough.

3. The method of claim 1 in which the object is tossed, rolled, or slid through the passageway.

4. The method of claim 2 wherein the processing accurately locates the person or object within the passageway despite changes in the angle, size, shape, and shading of the person or object from one frame of imagery to another frame thereof as the person or object moves through the passageway.

5. The method of claim 4 wherein the processing accurately identifies the person or object even if it changes direction as it moves through the passageway, or loiters within the passageway.

6. The method of claim 1 further including dividing the passageway into a warning zone and an alarm zone and providing a warning indication if the person or object moves through the warning zone in the disallowed direction and providing an alarm indication if the person or object moves into and/or through the alarm zone in the disallowed direction.

7. The method of claim 6 further including recording the frames of imagery of the person or object if either a warning indication or alarm indication is provided.

8. The method of claim 7 further including automatically playing back the frames of imagery for viewing on a monitor if an alarm indication is provided.

9. The method of claim 8 further including selectively playing back the frames of imagery for viewing on the monitor if only a warning indication is provided.

10. The method of claim 9 further including storing the frames of imagery for subsequent viewing.

11. The method of claim 10 in which frames of imagery are continuously recorded and the frames of imagery played back and/or stored include frames of imagery for a first predetermined interval prior to the warning or alarm indication being given and a second predetermined interval subsequent thereto.

12. The method of claim 1 in which the alarm indication is simultaneously provided within the passageway and areas adjacent thereto, and to a remote location at which activities within the passageway are monitored.

13. The method of claim 1 in which stereoscopically viewing the person or object comprises a first viewer for viewing people and a second viewer for viewing the objects, the first and second viewers simultaneously viewing the passageway.

14. Apparatus for passively and unobtrusively detecting movement of people or objects through a passageway where detection of people or objects moving in a disallowed direction through the passageway is critical and a rapid response to a detected movement necessary comprising:

a stereoscopic sensor sensing the person or object as it moves through the passageway in any direction and generating successive individual frames of three-dimensional imagery of the object;

a processor integrated with the sensor and processing the individual frames of imagery to distinguish the person or object from other people and objects simultaneously moving through the passageway regardless of the direction of movement of the people and objects; and, an alarm indicator responsive to an input from the processor, if the processor determines a person or object is moving through the passageway in the disallowed direction, to promulgate an alarm whereby any people or objects moving in the disallowed direction are passively and unobtrusively detected and their movement reported.

15. The apparatus of claim 14 in which the processor determines the location of a person or object within the passageway, at any location therewithin, the processor providing the alarm input to the alarm indicator only if the person or object is at a particular location within the passageway and is moving in the disallowed direction therethrough.

16. The apparatus of claim 15 which detects an object if is tossed, rolled, or slid through the passageway.

17. The apparatus of claim 15 in which the processor accurately locates the person or object within the passageway despite changes in the angle, size, shape, and shading of the person or object from one frame of imagery to another frame thereof as the person or object moves through the passageway.

18. The apparatus of claim 17 in which the processor accurately identifies the person or object even it changes direction as it moves through the passageway or loiters within the passageway.

19. The apparatus of claim 14 in which the passageway is divided into a warning zone and an alarm zone, the processor providing a warning indication to the alarm indicator if the person or object moves through the warning zone in the disallowed direction, and provides an alarm indication to the alarm indicator if the person or objects moves into and/or through the alarm zone in the disallowed direction.

20. The apparatus of claim 19 further including a recorder recording the frames of imagery of the person or object if either a warning indication or alarm indication is provided by the processor, and a monitor for viewing the frames of imagery.

21. The apparatus of claim 20 further including a controller controlling operation of the recorder to automatically play back the frames of imagery on the monitor if an alarm indication is provided by the processor.

22. The apparatus of claim 21 in which the controller further controls operation of the recorder for the recorder to selectively play back the frames of imagery for viewing on the monitor if a warning indication is provided by the processor.

23. The apparatus of claim 22 further including storage means storing the frames of imagery for subsequent viewing.

24. The apparatus of claim 22 in which frames of imagery are continuously recorded and the frames of imagery played back and/or stored include frames of imagery for a first predetermined interval prior to a warning or alarm indication being given and a second predetermined interval subsequent thereto.

25. The apparatus of claim 14 in which the alarm indication is simultaneously provided within the passageway and areas adjacent thereto, and to a remote location at which activities within the passageway are monitored.

26. The apparatus of claim 17 in which the stereoscopic sensor comprises a first viewer for viewing people and a second viewer for viewing the objects, the first and second viewers simultaneously viewing the passageway.

27. The apparatus of claim 17 in which the stereoscopic sensor views people and the apparatus includes a second viewer viewing the objects, the first and second viewers simultaneously viewing the passageway.

28. The apparatus of claim 14 in which the stereoscopic sensor is installed above the passageway at a predetermined height above the passageway's floor.

29. The apparatus of claim 28 further including a housing module in which the sensor is installed, and a track within the module on which the sensor is mounted, the sensor being movable along the track to adjust the position of the sensor such that the sensor's field of view substantially encompasses the entire passageway.

30. The apparatus of claim 29 further including a plurality of stereoscopic sensors and a separate housing module in which each sensor is installed, the housing modules being mounted above the passageway adjacent each other and the tracks on which the respective sensors are mounted being interconnected to form a continuous track over which the sensors are moved so the combined fields of view of the sensors overlap and substantially encompass the entire passageway.

31. The apparatus of claim 14 further including a log for recording occurrences of people or objects detected moving in the disallowed direction.

32. The apparatus of claim 31 in which occurrence events are recorded in chronological order in log beginning with the most recent occurrence.

33. The apparatus of claim 32 in which log entries are color coded to distinguish an alarm occurrence from a warning occurrence so an operator can readily distinguish between types of events.

34. The apparatus of claim 32 in which each log entry includes the date and time the event occurred; and, if the apparatus is used for monitoring more than one egress passageway, listing the sensor which identifies the location where the event occurred.

* * * * *